United States Patent [19]

Davis et al.

[11] Patent Number: 4,802,877

[45] Date of Patent: Feb. 7, 1989

[54] METHOD AND APPARATUS OF TYING THE NECK OF A BALLOON

[75] Inventors: John C. Davis, Palatine; James A. Milne, Crystal Lake, both of Ill.

[73] Assignee: CTI Industries, Barrington, Ill.

[21] Appl. No.: 154,317

[22] Filed: Feb. 10, 1988

[51] Int. Cl.[4] ..... A63H 3/06; B65H 69/04

[52] U.S. Cl. ..... 446/222; 289/1.5; 289/17

[58] Field of Search ..... 289/1.5, 17, 18.1; 446/220, 222

[56] References Cited

U.S. PATENT DOCUMENTS

| | | | |
|---|---|---|---|
| 2,677,487 | 5/1954 | Friedman | 289/18.1 X |
| 2,882,645 | 4/1959 | Stivers | 446/222 X |
| 4,008,912 | 2/1977 | Kotov | 289/1.5 X |
| 4,428,149 | 1/1984 | Brown | 446/222 |
| 4,510,653 | 4/1985 | Semanko | 446/222 X |
| 4,729,749 | 3/1988 | Milne | 446/222 |

*Primary Examiner*—Louis K. Rimrodt
*Attorney, Agent, or Firm*—Wood, Dalton, Phillips Mason & Rowe

[57] ABSTRACT

A method of tying a balloon having an inflatable bulb bounding a chamber, a flexible neck with a passageway in communication with the chamber, and a filling opening in the neck through which a fluid can be directed into the neck passageway and inflation chamber. The method contemplates the steps of providing a device with a housing having first and second elongate legs projecting therefrom in substantially parallel alignment, placing the neck of the balloon between the first and second legs, situating a length of flexible line across the neck in lengthwise alignment with and adjacent to one of the legs, twisting the legs about their length to thereby roll the balloon neck against itself and surround the line, and tying the line against itself so that the neck is embraced by the line. The invention is also concerned with a hand tool device for carrying out the method.

17 Claims, 1 Drawing Sheet

METHOD AND APPARATUS OF TYING THE NECK OF A BALLOON

BACKGROUND OF THE INVENTION

Field of the Invention

This invention relates to decorative balloons of the type having an inflatable bulb and integral flexible filling neck and, more particularly, to a method of tying a line around the neck to prevent deflation of the bulb through the neck and facilitate attachment of the balloon to a support such as a rod, and an apparatus for carrying out the method.

Background Art

There has been an increasing use of metallized materials such as nylon to manufacture decorative balloons. Such balloons are commonly formed by precutting sheet stock in the desired shape of a bulb and an integral elongate filler neck. Two similarly shaped sheets are superposed and heat sealed together around their peripheral edges. A filler opening is provided in the neck to introduce air or lighter-than-air gas through a passage defined by the neck into a chamber bounded by the bulb for inflation thereof.

One problem with metallized nylon balloons is that the filler necks thereon do not lend themselves to being tied to seal gas in the bulb as do conventional, latex balloons. This has posed a serious problem to street and carnival vendors as well as small shop owners, and the like, who inflate the balloons at the point of sale.

Another problem that has been encountered with metallized nylon balloons is that there is generally no provision thereon for tying the balloons onto a support such as a rod, and the like.

SUMMARY OF THE INVENTION

The present invention is specifically directed to overcoming the above-enumerated problems in a novel and simple manner.

According to the invention, a hand tool is provided to secure the flexible neck of an inflatable balloon against fluid leakage. The tool has a housing with forward and rearward end portions positioned on a longitudinal axis of the housing. The housing has an exterior lateral surface between the end portions to be grasped and facilitate rotation of the housing about its longitudinal axis. First and second adjacent, elongate legs at the forward end of the housing extend outwardly to a position along the extension of the longitudinal axis of the housing and are adapted to receive the neck of a balloon therebetween in a starting position preparatory to a tying operation. A continuous tying line extends from a supply and has a free end positioned adjacent one of the legs with the legs in the starting position.

The invention also comprehends a method of tying a balloon having an inflatable bulb bounding a chamber, a flexible neck with a passageway in communication with the chamber, and a filling opening in the neck through which a fluid can be directed into the neck passageway and inflation chamber. The method contemplates the steps of providing a hand tool device with a housing having first and second elongate legs projecting therefrom in substantially parallel alignment, placing the neck of the balloon between the first and second legs, situating a length of flexible line across the neck in lengthwise alignment with and adjacent to one of the legs, twisting the legs about their length to thereby roll the balloon neck against itself and surround the line, and tying the line against itself so that the neck is embraced by the line.

It is possible with the inventive device to readily roll the balloon neck once the bulb has been inflated and thereafter knot the line around the tightly wound convolutions. The line can be drawn sufficiently tightly around the convolutions to seal the passageway defined by the neck and thereby prevent passage of fluid within the bulb outwardly through the filling opening.

At the same time, the multiple neck convolutions provide a multi-ply configuration which can be utilized to securely anchor the balloon to a desired support using a flexible tie line.

In a preferred form, the device has a releasable line retaining structure which maintains a desired position for the line relative to the hand tool device as the neck is being rolled. In a preferred form, this retaining structure consists of a through bore in the housing of the device aligned generally with the length of the legs. The bore is sufficiently large to allow the device to be readily drawn off of the line or ribbon as the device is separated or removed from the convolutions of the balloon neck.

Preferably, the housing has a cylindrical surface with a central axis aligned with the length of the legs. The surface can be conveniently rolled between the fingers of a user to rapidly and smoothly roll the balloon neck.

DETAILED DESCRIPTION OF THE DRAWINGS

Figure 1:
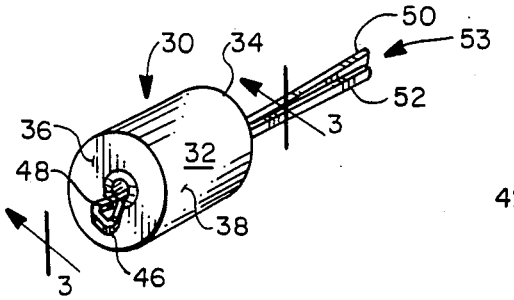
FIG. 1 is a perspective view of a hand tool device for tying, a balloon according to the present invention.

In FIGS. 4–10, a balloon of the type to be tied according to the present invention using the inventive device is shown at 10. The balloon consists of a decorative bulb 12 and an integral flexible neck 14. The bulb 12 and neck 14 are defined by two joined, superposed sheets 16, 18, of metallized film material, with the film material preferably being nylon and the metallized layer preferably being aluminum. The use of other gas impermeable material is also contemplated by the invention.

The sheets 16, 18 are heat sealed together along their peripheral edges 20 to thereby define a sealed inflation chamber 22 bounded by that portion of the sheets 16, 18 defining the bulb 12 and a passageway 24 in the neck 14 in communication with the inflation chamber 22. A filling opening 26 is provided in one sheet 16 adjacent the free end of the neck 14. The opening 26 accommodates a conventional type spout 28 from which compressed air or a lighter-than-air gas, such as helium, can be discharged. To fill the balloon 10, the spout 28 is directed through the opening 26 into the neck passageway 24 and a charge of compressed fluid is released into the chamber 22 to inflate the bulb 12 to the state shown in FIGS. 5, 6, 8 and 9.

Figure 2:
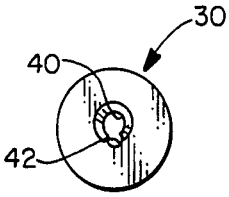
FIG. 2 is an end elevation view of the device in FIG. 1.
Figure 3:
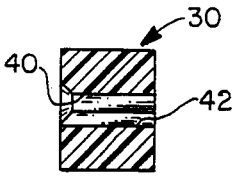
FIG. 3 is a section view of a housing on the device taken along line 3—3 of FIG. 1.

Once the balloon is inflated, the neck 14 is rolled and tied utilizing a hand tool device, according to the present invention, shown in detail in FIGS. 1–3 at 30. The device 30 consists of a cylindrically-shaped housing 32 having forward and rear end portions 34, 36, respectively on the longitudinal axis of the housing. The forward and rear housing end portions 34, 36 have axially oppositely facing flat walls extending generally perpendicular to the axis of a lateral cylindrical outer surface 38 on the housing 32 between the end portions 34, 36. The housing 32 has a first through bore 40 and a second through bore 42 which radially intersects the first bore 40. Each bore 40, 42 extends generally parallel to the axis of the outer surface 38 of the housing 32. The first bore 40 has a diameter chosen to loosely accept a flexible tying line 44 (FIGS. 4–10), which may be a ribbon, string or other line suitable for tying the balloon neck 14. The bore 40, as seen clearly in FIG. 2, has a center that is slightly offset from the center of the outer surface 38 of the housing 32.

The second bore 42 is slightly offset from the center of the outer surface 38 of the housing 32 and has a diameter chosen to closely accept a conventional cotter pin 46 having an enlarged head 48 with integral, generally parallel, adjacent long and short legs 50, 52, respectively. To assemble the cotter pin 46, the free ends of the legs 50, 52 are squeezed against each other and directed into and through the bore 42. The legs 50, 52 of the cotter pin 46 are forced through the bore 42 until the head 48 resides at the wall 34. The legs 50, 52 are frictionally held in place and project in cantilever fashion from the wall 36 with a slight space 53 maintained between the legs 50, 52.

Figure 4:
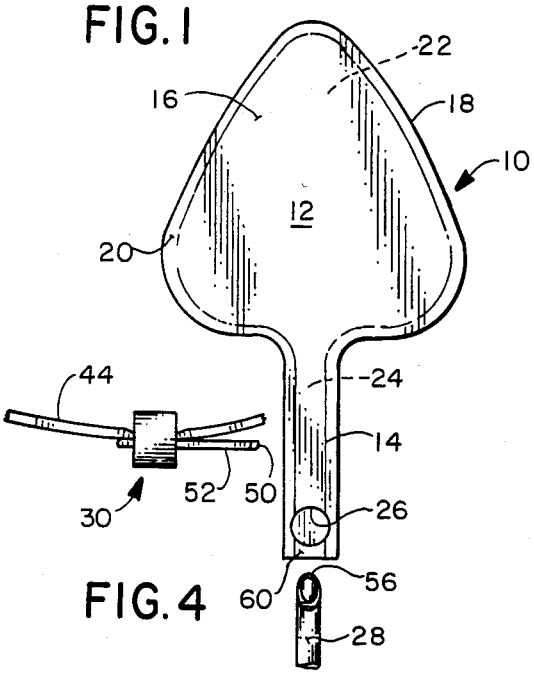
FIG. 4 is an elevation view of a balloon of the type to be tied by the inventive device in FIGS. 1–3 with the device situated to engage a neck on the balloon at the initiation of a tying operation.
Figure 5:
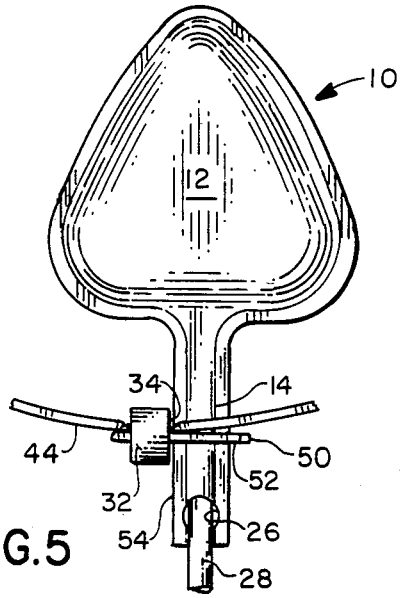
FIG. 5 is a view similar to that in FIG. 4 with the device engaging the neck of the balloon and a filler spout inserted through the neck to inject a compressed fluid into the balloon.
Figure 6:
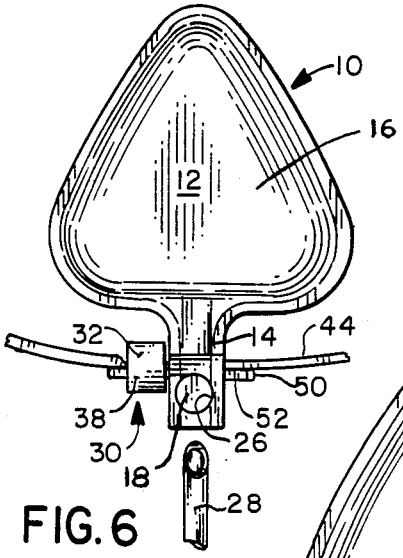
FIG. 6 is a view as in FIG. 5 with the balloon neck rolled up by the device and the filler spout removed.
Figure 7:
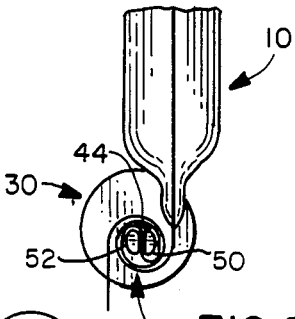
FIG. 7 is an enlarged, side elevation view of the rolled portion of the neck in FIG. 6.
Figure 8:
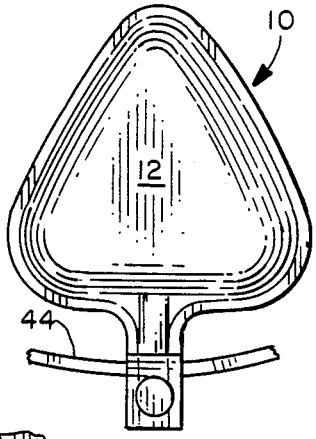
FIG. 8 is a view similar to that in FIG. 6 with the device removed from the neck and a flexible line in position to be tied.
Figure 9:
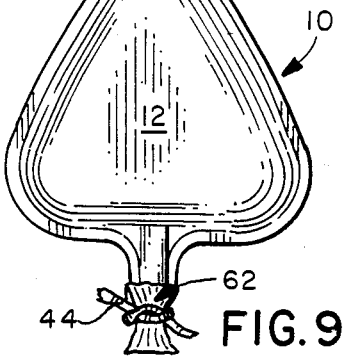
FIG. 9 is a view similar to that in FIG. 8 with the line tied against itself to embrace the convolutions of the neck.
Figure 10:
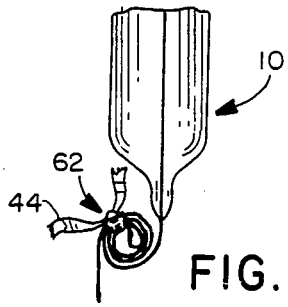
FIG. 10 is an enlarged, side elevation view of the rolled portion of the neck in FIG. 9.

To initiate a tying operation, the free end of a supply of ribbon 44 or the like is directed through the bore 40 in the housing 32 so that the ribbon projects from both walls 34, 36. The bulb 12 is inflated by directing the spout 28 through the neck opening 26 and into the passageway 24 and releasing a charge of compressed fluid into the inflation chamber 22. The device 30 is then aligned as shown in FIG. 4 and the balloon neck 14 is directed through the space 53 between the legs 50, 52 as shown in FIG. 5 until the wall 36 of the housing 32 abuts the neck edge 54 to thereby limit left to right movement in FIG. 5 of the device 30 relative to the balloon neck 14. The legs 50, 52 can be engaged with the neck 14 before the spout 28 is withdrawn and in that case the device 30 is attached at a point above the free edge 56 of the spout 28, with the spout 28 penetrating the opening 26 and neck 14, as shown in FIG. 5. The legs 50, 52 are then twisted or rotated about their length to roll the neck 14 upwardly towards the bulb and define a plurality of convolutions at 58 (FIG. 7). As the neck 14 is rolled, the free end 60 is drawn upwardly towards the bulb 12 and slides off of the spout 28, as shown in FIG. 6. To effect twisting of the legs 50, 52, the housing 32 is grasped as between two fingers by a user and the surface 38 is rolled against the user's fingers. As the housing 32 is being rolled with one hand, the bulb 12 is grasped by the user's other hand and the housing 32 is urged away from the bulb to draw the neck 14 taut and thereby tighten the convolutions on the neck to seal off the neck passageway 24 so that the gas cannot communicate from the bulb chamber 22 to the opening 26.

Once the neck 14 is rolled as in FIG. 7, the device 30 can be separated from the balloon 10 by drawing the device 30 from right to left in FIG. 6 away from the balloon neck 14. The ribbon 44 slides through the bore 40 and thus remains in place captively surrounded by the neck convolutions 58 and projects from both sides of the neck 14, as shown clearly in FIGS. 7 and 8. Thereafter, the ribbon is tied against itself and cinched as shown at 62 in FIGS. 9 and 10 so that the ribbon 44 closely embraces the neck convolutions 58. As the line 44 is cinched, the neck 14 folds about its middle and the sides of the neck 14 collapse inwardly and fold closely against each other and are squeezed to thereby positively cut off the neck passageway 24 and prevent communication of gas from the bulb chamber 22 to the opening 26.

By tying the balloon neck 14 in the aforementioned manner, in addition to sealing the neck passageway 24, convolutions 58 are provided that facilitate tying of the balloon 10 onto a support such as a stick, decorative stem, or the like. A separate line can be utilized to tie around the convolutions 58 and anchor the balloon neck to a support. Alternatively, the line 44 used to tie the neck 14 can be made sufficiently long to be tied around the support.

It should be understood that the foregoing description is made for purposes of demonstrating a preferred form of the inventive device and a method of using the same. Variations can be made in the structure and its manner of use without departing from the invention.

We claim:

1. A hand tool adapted to secure a flexible neck of an inflatable balloon against fluid leakage, said hand tool comprising:

a housing having a forward end portion and a rearward end portion each positioned on the longitudinal axis of the housing, said housing having an exterior lateral surface between the end portions for manual grasping to rotate the housing about its longitudinal axis;

first and second elongate legs mounted in adjacent position in the forward end of the housing and extending outwardly of the housing to a position along the extension of said longitudinal axis of the housing, said legs being adapted to receive the neck of the balloon therebetween in a starting position preparatory to a tying operation; and a supply of continuous tying line having a free end positioned adjacent and in alignment with one of said legs when the legs are in starting position, whereby rotation of said housing and legs rolls the balloon neck into tight convolutions about said free end and legs to a tying position, and subsequent withdrawal of the legs from the convolutions permits the free end of the line captured within the convolutions to be securely tied about the convolutions to prevent fluid leakage through the balloon neck.

2. A hand tool adapted to secure a flexible neck of an inflatable balloon against fluid leakage, said hand tool comprising:

a housing having a forward end portion and a rearward end portion each positioned on a longitudinal axis of the housing, said housing having an exterior lateral surface between the end portions for manual grasping to rotate the housing about its longitudinal axis;

first and second elongate legs mounted in adjacent position in the forward end of the housing and extending outwardly of the housing to a position along the extension of said longitudinal axis of the housing, said legs being adapted to receive the neck of a balloon therebetween in a starting position preparatory to a tying operation;

a continuous tying line extending from a supply of said line and having a free end; and means for positioning said line free end adjacent one of said legs when the legs are in starting position, whereby rotation of said housing and legs rolls the balloon neck into tight convolutions about said free end and legs to a tying position, and subsequent withdrawal of the legs from the convolutions permits the free end of the line captured within the convolutions to be securely tied about the convolutions to prevent fluid leakage through the balloon neck.

3. A hand tool according to claim 2 in which said positioning means comprises means for mounting a portion of the continuous line slidably in the housing and for positioning the free end of said line adjacent one of said legs when the legs are in starting position.

4. A hand tool according to claim 2 wherein said positioning means comprises a through bore in said housing substantially parallel to the longitudinal axis of the housing.

5. A hand tool according to claim 4 wherein the axis of the through bore is adjacent to the longitudinal axis of the housing.

6. A method of tying a balloon having a bulb bounding an inflation chamber, a flexible neck with a passageway in communication with the inflation chamber, and a filling opening in said neck through which a fluid can be directed through the passageway into the inflation chamber, said method comprising the steps of:

providing a device with a housing having first and second elongate legs projecting therefrom in substantially parallel alignment;

placing the neck of the balloon between the first and second legs;

situating a length of flexible line across the neck in lengthwise alignment with and adjacent to one of the legs;

twisting the legs about their length to thereby roll the balloon neck against itself into convolutions surrounding the line; and tying the line against itself so that the convolutions of the neck are embraced by the line.

7. The method of tying a balloon according to claim 6 further including the step of drawing the tied line sufficiently tightly to collapse the embraced neck and seal the neck passageway to thereby prevent communication of fluid from said inflation chamber through said filling opening.

8. The method of tying a balloon according to claim 6 further including the step of separating the device from the balloon by drawing the legs out of the neck in a line substantially parallel to the length of the legs before the ine is tied against itself.

9. The method of tying a balloon according to claim 8 wherein there are means on said device for releasably retaining the line and further including the step of separating the device from the retaining means on the device.

10. The method of tying a balloon according to claim 9 wherein said line retaining means comprises a through bore in the housing of the device and further comprising the steps of threading the line through the through bore before twisting the legs of the device to roll the balloon neck and pulling the string out of the bore of the housing as the device is separated from the balloon.

11. The method of tying a balloon according to claim 6 wherein the housing of the device has a cylindrical outer surface with an axis substantially parallel to the length of the legs and the legs are twisted by manipulation of the outer surface of the housing.

12. A method of tying a balloon having a bulb bounding an inflation chamber, a flexible neck with a passageway in communication with the inflation chamber, and a filling opening in said neck through which a fluid can be directed through the passageway into the inflation chamber, said method comprising the steps of:

providing a device having means to engage the balloon neck;

engaging the balloon neck with the device;

placing a flexible line across the balloon neck;

twisting the device to thereby roll the balloon neck against itself and surround the line;

separating the device from the balloon neck; and tying the line against itself so that the neck is embraced by the line.

13. The method of tying a balloon according to claim 12 wherein said device comprises a housing with a pair of adjacent legs supported from the housing in cantilever fashion and the balloon neck is engaged by the device by situating the balloon neck between the legs.

14. The method of tying a balloon according to claim 12 wherein said housing has a cylindrical outer surface and the device is twisted by rolling the outer surface of the device.

15. The method of tying a balloon according to claim 14 wherein said housing has a flat wall substantially perpendicular to the axis of the cylindrical outer surface for abutment against the balloon neck with the device and balloon engaged.

16. The method of tying a balloon according to claim 12 wherein there are means on the device for releasably retaining the line on the device and further including the step of retaining the line on the line retaining means before twisting the device to roll the balloon neck against itself.

17. The method of tying a balloon according to claim 12 further including the step of drawing the tied line sufficiently tightly to collapse the embraced neck and seal the neck passageway to thereby prevent communication of fluid from said inflation chamber through said filling opening.

* * * * *